US007391983B2

(12) United States Patent
Tatematsu et al.

(10) Patent No.: US 7,391,983 B2
(45) Date of Patent: Jun. 24, 2008

(54) METHOD AND APPARATUS FOR CONTROLLING IMAGE FORMING OPERATION OF AN IMAGE FORMING APPARATUS

(75) Inventors: Hideki Tatematsu, Hyogo (JP); Kenji Asakura, Kyoto (JP); Masaru Imai, Osaka (JP); Tadafumi Shimizu, Fukuoka (JP); Masahiro Samei, Osaka (JP); Keiichi Matsuzaki, Fukuoka (JP); Kazunori Matsuo, Fukuoka (JP); Shoichi Kitagawa, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 136 days.

(21) Appl. No.: 10/566,203

(22) PCT Filed: Jul. 29, 2004

(86) PCT No.: PCT/JP2004/011207

§ 371 (c)(1),
(2), (4) Date: May 15, 2006

(87) PCT Pub. No.: WO2005/013014

PCT Pub. Date: Feb. 10, 2005

(65) Prior Publication Data

US 2006/0251440 A1 Nov. 9, 2006

(30) Foreign Application Priority Data

Jul. 30, 2003 (JP) ..... 2003-283044

(51) Int. Cl.
*G03G 15/20* (2006.01)

(52) U.S. Cl. ..... 399/69; 399/43; 399/44; 399/329; 430/124.1

(58) Field of Classification Search ..... 399/69, 399/43, 75, 76, 38, 70, 67, 44, 329; 430/124.1; 347/156
See application file for complete search history.

(56) References Cited

U.S. PATENT DOCUMENTS 5,299,870 A * 4/1994 Moritani ..... 374/153

(Continued)

FOREIGN PATENT DOCUMENTS

JP 8-227249 9/1996

(Continued)

OTHER PUBLICATIONS

English language Abstract of JP 10-228196.

(Continued)

*Primary Examiner*—Sophia S Chen
(74) *Attorney, Agent, or Firm*—Greenblum & Bernstein, P.L.C.

(57) ABSTRACT

The present invention relates to an image forming apparatus that enables the occurrence of print defects due to a first print start time delay to be eliminated without using a temperature sensor that has a small thermal time constant. When the temperature of a fixing belt serving as an image heating body is greater than or equal to a predetermined temperature following the elapse of a fixed time after an image forming operation is started, recording paper is transported to a nip area (fixing area) of a fixing apparatus before the temperature detected by a temperature sensor reaches a predetermined image fixing temperature, and an image forming operation is started immediately.

17 Claims, 6 Drawing Sheets

U.S. PATENT DOCUMENTS

| | | | | |
|---|---|---|---|---|
| 5,899,599 | A * | 5/1999 | Kato | 399/69 |
| 6,025,856 | A * | 2/2000 | Ozawa et al. | 346/74.3 |
| 2002/0085867 | A1 * | 7/2002 | Samei et al. | 399/329 |
| 2003/0161651 | A1 * | 8/2003 | Tatematsu et al. | 399/69 |
| 2005/0201768 | A1 | 9/2005 | Tatematsu et al. | 399/69 |
| 2005/0214012 | A1 * | 9/2005 | Matsumoto | 399/69 |
| 2006/0072931 | A1 | 4/2006 | Asakura et al. | 399/33 |

FOREIGN PATENT DOCUMENTS

| | | |
|---|---|---|
| JP | 10-74007 | 3/1998 |
| JP | 10-123861 | 5/1998 |
| JP | 10-228196 | 8/1998 |

OTHER PUBLICATIONS

English language Abstract of JP 10-123861.
English language Abstract of JP 10-74007.
English language Abstract of JP 8-227249.

* cited by examiner

IMAGE FORMING START TIME (ts2)

| | 10°C～17°C | 18°C～ |
|---|---|---|
| 100 mm/s | 15 sec | 13 sec |
| 124 mm/s | 18 sec | 16 sec |

METHOD AND APPARATUS FOR CONTROLLING IMAGE FORMING OPERATION OF AN IMAGE FORMING APPARATUS

TECHNICAL FIELD

The present invention relates to an image forming apparatus such as a copier, facsimile, or printer, and more particularly to an image forming apparatus provided with a heat-fixing apparatus that heat-fixes an unfixed toner image formed and held on a recording medium by an electrophotographic image forming section onto that recording medium.

BACKGROUND ART

With this kind of image forming apparatus, a heat roller type, belt type, or similar heat-fixing apparatus has traditionally been used as a fixing apparatus that heat-fixes an unfixed toner image formed and held on a recording medium such as plain paper or an OHP sheet.

A known example of this kind of heat-fixing apparatus is provided with a rotatable heating roller that has a heat source such as a halogen lamp or heater, an endless fixing belt that presses against this heating roller and rotates together with this heating roller, and a pressure pad that is positioned on the inner side of this fixing belt, presses the fixing belt against the heating roller, and forms a fixing nip by means of the pressure area between the fixing belt and the heating roller (see, for example, Unexamined Japanese Patent Publication No. HEI 10-228196).

In recent years, due to demands such as shorter warm-up time and better energy-saving characteristics for image forming apparatus, attention has been drawn to heat-fixing apparatuses that use a heat-producing section employing induction heating (IH), which allows rapid and highly efficient heating, as the heat source, and reach the desired image fixing temperature in a short time (See, for example, Unexamined Japanese Patent Publication No. HEI 10-123861).

FIG. 1 is a schematic configuration diagram of a heat-fixing apparatus that uses an IH heat-producing section as the heat source. As shown in FIG. 1, this heat-fixing apparatus has an exciting coil 14 located inside a fixing roller 12 serving as an image heating body, and fixing roller 12 is made to produce heat by causing generation of an alternating field by means of this exciting coil 14 and a core 17 composed of ferrite or the like, and causing an eddy current to be generated in fixing roller 12. A recording medium 10 bearing an unfixed toner image 11 is then fed to the pressure area between fixing roller 12 and a pressure roller 13, and unfixed toner image 11 is fixed onto recording medium 10.

Another heat-fixing apparatus using an IH heat-producing section as a heat source has also been proposed that has a configuration in which a fixing roller serving as an image heating body is formed as a thin metal sleeve, and this metal sleeve is sandwiched and rotated by inner and outer pressure members (see, for example, Unexamined Japanese Patent Publication No. HEI 10-74007).

In a heat-fixing apparatus used in this kind of conventional image forming apparatus, the temperature of the image heating body such as a fixing belt, fixing roller, and so forth is normally measured by means of a temperature sensor positioned in contact with the image heating body. The calorific value of the heat source is then controlled based on the measurement result of this temperature sensor so that the temperature of the image heating body is maintained at an image fixing temperature suitable for heat-fixing an unfixed toner image onto a recording medium.

In the case of a heat-fixing apparatus that uses a halogen lamp or heater as a heat source, the warm-up time until the image heating body rises to the predetermined image fixing temperature is long, and therefore the thermal time constant of the temperature sensor has not been a problem.

However, in the case of a heat-fixing apparatus that uses an IH heat-producing section as a heat source, or that uses a fixing belt as an image heating body, the warm-up time is short (30 seconds or less, for example), and therefore the thermal time constant of the temperature sensor has an effect.

That is to say, while the use of an inexpensive temperature sensor is generally desirable with this kind of image heating apparatus in order to keep costs low, there is a drawback that an inexpensive temperature sensor normally has a large thermal time constant, and responsiveness to a rapid change in temperature is poor. Therefore, if a temperature sensor with a large thermal time constant is used in an image forming apparatus that has a short warm-up time, there is a problem of the actual temperature of the image heating body rising before the temperature detected by the temperature sensor rises, resulting in major overshoot.

Also, in this kind of image forming apparatus, control is performed so that an image forming operation is started when the temperature detected by the temperature sensor reaches the predetermined image fixing temperature. Therefore, if a temperature difference occurs between the actual temperature of the image heating body and the temperature detected by the temperature sensor as described above, there is a problem in that the first print start time is delayed in proportion to this temperature difference. This kind of first print start time delay is pronounced when image forming is performed after the image heating body is heated from a state in which the environmental temperature of the heat-fixing apparatus is close to room temperature.

Thus, a problem with this kind of conventional image forming apparatus is that the actual temperature of the image heating body becomes higher than the predetermined image fixing temperature due to the first print start time delay, and the glossiness of the first printed sheet is abnormally high.

The occurrence of print defects due to such first print start time delay can be eliminated by using a temperature sensor that is highly responsive to rapid temperature changes and has a small thermal time constant. However, a problem associated with the use of a temperature sensor with a small thermal time constant is increased cost.

DISCLOSURE OF INVENTION

It is an object of the present invention to provide an image forming apparatus that enables the occurrence of print defects due to first print start time delay to be eliminated without using a temperature sensor that has a small thermal time constant.

The idea of the present invention is that an image forming operation of an image forming section is controlled so that heat-fixing of an unfixed toner image onto a recording medium is started at predetermined timing before the temperature detected by a temperature sensor that detects the temperature of an image heating body reaches the image fixing temperature.

According to one aspect of the present invention, an image forming apparatus has an image forming section that forms and holds an unfixed toner image on a recording medium fed to an image forming area, and a heat-fixing apparatus that heats the recording medium transported from the image forming area in a predetermined fixing area and heat-fixes the unfixed toner image onto the recording medium. The aforementioned heat-fixing apparatus has an image heating body that heats an unfixed toner image on a recording medium, a heat-producing section that heats the aforementioned image heating body, a temperature sensor that detects the temperature of the aforementioned image heating body, and a calorific value control section that controls the calorific value of the aforementioned heat-producing section based on the temperature detected by the aforementioned temperature sensor so that the temperature of the aforementioned image heating body is maintained at an image fixing temperature suitable for heat-fixing an unfixed toner image onto a recording medium. This image forming apparatus has an image forming operation control section that controls an image forming operation of the aforementioned image forming section so that heat-fixing of an unfixed toner image onto a recording medium is started at predetermined timing before the temperature detected by the aforementioned temperature sensor reaches the aforementioned image fixing temperature.

BEST MODE FOR CARRYING OUT THE INVENTION

Figure 1:
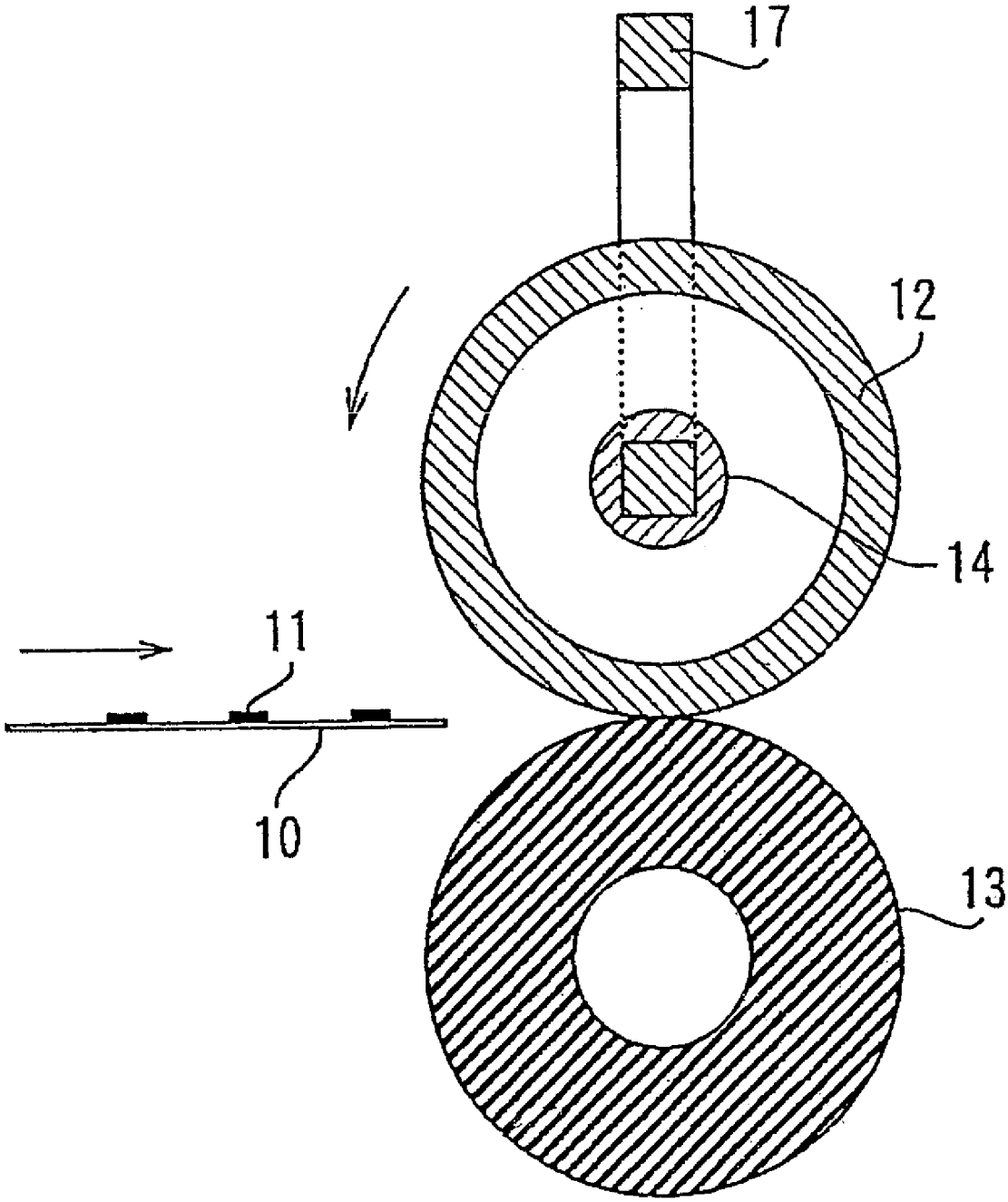
FIG. 1 PRIOR ART
FIG. 1 is a cross-sectional drawing showing the schematic configuration of a conventional heat-fixing apparatus that uses an IH heat-producing section as a heat source.

With reference now to the accompanying drawings, embodiments of the present invention will be explained in detail below. In the drawings, configuration elements and equivalent parts having the same configuration or function are assigned the same codes, and duplicate descriptions thereof are omitted.

Embodiment 1

First, a detailed description will be given of an image forming apparatus according to Embodiment 1 of the present invention.

Figure 2:
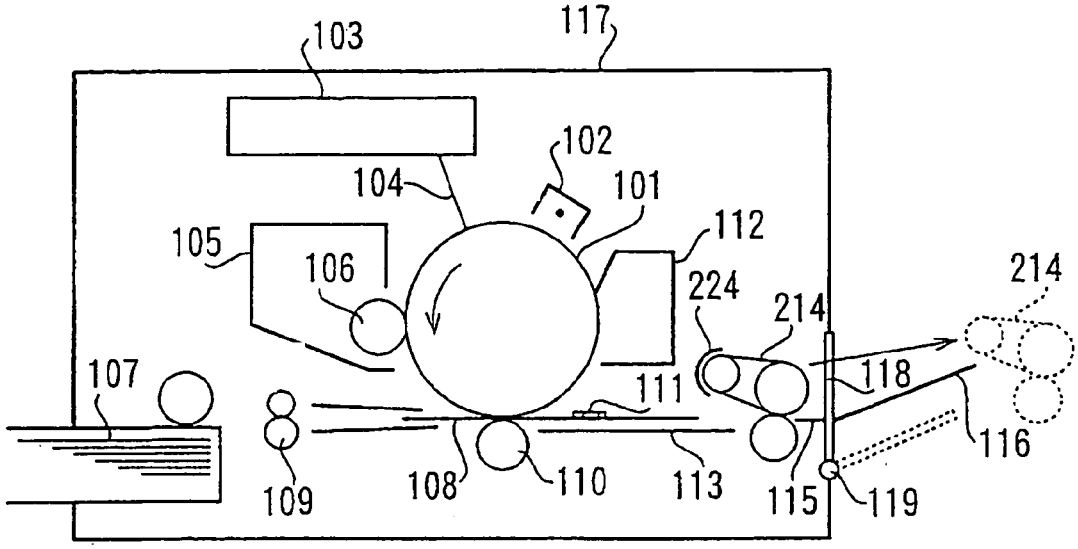
FIG. 2 is a schematic diagram showing the overall configuration of an image forming apparatus according to Embodiment 1 of the present invention.

FIG. 2 is a schematic diagram showing the overall configuration of the image forming apparatus according to Embodiment 1 of the present invention. The configuration and operation of this image forming apparatus will first be described.

As shown in FIG. 2, an electrophotographic photosensitive body (hereinafter referred to as "photosensitive drum") 101 is mounted in a freely rotatable fashion in an image forming apparatus body 117 of this image forming apparatus. In FIG. 2, photosensitive drum 101 is rotated at a predetermined circumferential speed in the direction indicated by the arrow while its surface is uniformly charged to a negative predetermined dark potential V0 by an electrifier 102.

A laser beam scanner 103 outputs a laser beam 104 modulated in accordance with a time series electrical digital pixel signal of image information input from a host apparatus such as an image reading apparatus or computer (not shown).

The uniformly charged surface of photosensitive drum 101 is exposed by scanning by laser beam 104. By this means, the absolute value of the potential of exposed parts of photosensitive drum 101 falls and becomes a light potential VL, and an electrostatic latent image is formed on the surface of photosensitive drum 101. This electrostatic latent image undergoes reversal development by means of negatively charged toner of a developing unit 105, and is developed (made a toner image).

Developing unit 105 is provided with a rotated developing roller 106. Developing roller 106 is positioned opposite photosensitive drum 101, and a thin layer of toner is formed on its peripheral surface. A developing bias voltage with an absolute value smaller than dark potential V0 of photosensitive drum 101 and larger than light potential VL is applied to developing roller 106. By this means, the toner on developing roller 106 is transferred only to light potential VL parts of photosensitive drum 101, an electrostatic latent image is developed, and an unfixed toner image (hereinafter referred to simply as "toner image") 111 is formed on photosensitive drum 101.

Meanwhile, a recording paper 108 as a recording medium is fed one sheet at a time from a paper feed section 107. Fed recording paper 108 is transported through a pair of registration rollers 109 to the nip area between photosensitive drum 101 and a transfer roller 110 at appropriate timing synchronized with the rotation of photosensitive drum 101. By this means, toner image 111 on photosensitive drum 101 is transferred to recording paper 108 by transfer roller 110 to which a transfer bias is applied.

Recording paper 108 on which toner image 111 is formed and held in this way is guided by a recording paper guide 113 and separated from photosensitive drum 101, and then transported toward the fixing area of a heat-fixing apparatus (hereinafter referred to simply as "fixing apparatus") 214. Once transported to this fixing area, recording paper 108 has toner image 111 heat-fixed onto it by fixing apparatus 214.

After passing through fixing apparatus 214, recording paper 108 onto which toner image 111 has been heat-fixed is guided by an ejection guide 115, and is ejected onto an output tray 116 attached to the outside of image forming apparatus body 117.

A fixing door 118 for insertion and removal of fixing apparatus 214 and handling of paper jams is provided on the attachment area of output tray 116. This fixing door 118 pivots about a hinge 119, and is opened and closed together with output tray 116. Fixing apparatus 214 can be inserted into and removed from image forming apparatus body 117 in a direction perpendicular to the axis of a heat-producing roller 221 (see FIG. 3). In FIG. 2, the dotted line shows the situation with fixing apparatus 214 removed from image forming apparatus body 117, and the solid line shows the situation with fixing apparatus 214 inserted into image forming apparatus body 117. As shown in FIG. 2, only the image heating body component parts of fixing apparatus 214 are inserted into and removed from image forming apparatus body 117, leaving an exciting apparatus 224 comprising an exciting coil 225 described later herein (see FIG. 3) and so forth in image forming apparatus body 117.

After recording paper 108 has been separated, photosensitive drum 101 has residual material such as untransferred toner remaining on its surface removed by a cleaning apparatus 112, and is made ready for the next image forming operation.

The fixing apparatus of the image forming apparatus according to this embodiment will now be described in further detail, taking a specific example.

Figure 3:
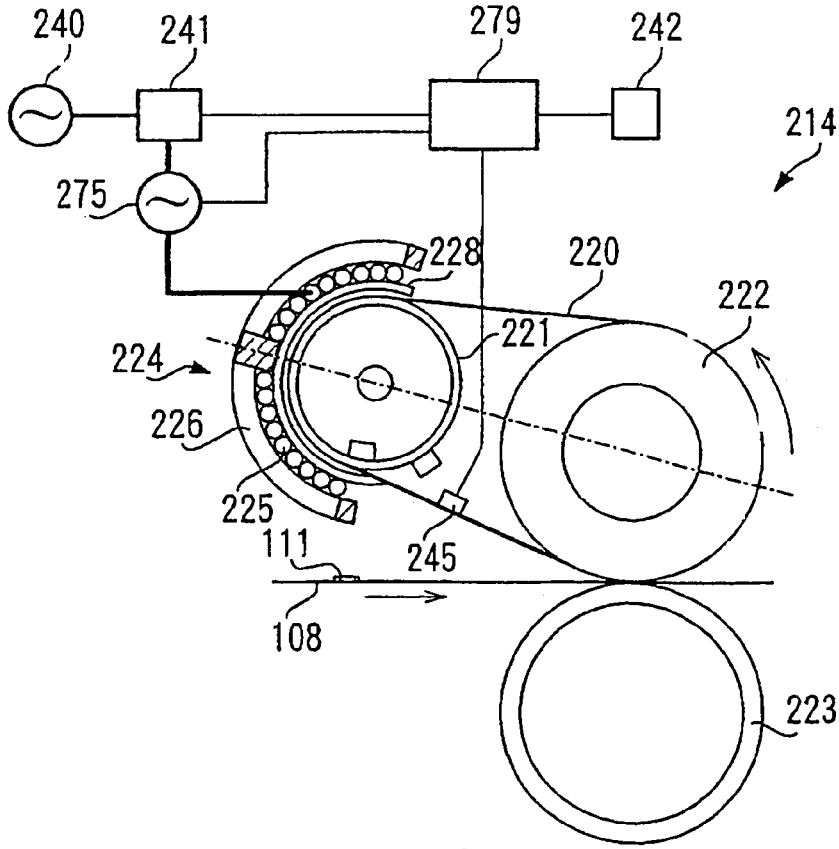
FIG. 3 is a schematic diagram showing a sample configuration of a heat-fixing apparatus in the image forming apparatus according to Embodiment 1.

FIG. 3 is a schematic diagram showing a sample configuration of fixing apparatus 214.

In FIG. 3, exciting coil 225 forming part of exciting apparatus 224 is formed using litz wire comprising bundled thin wires, and the cross-sectional shape is formed as a semicircle so as to cover a fixing belt 220 serving as an image heating body passing over heat-producing roller 221 serving as a heat-producing section.

A core 226 of ferrite is attached to the center and part of the rear of exciting coil 225. As an alternative to ferrite, a high-permeability material such as permalloy can also be used as the material of core 226. Exciting coil 225 is located on the outer side of heat-producing roller 221, and an excitation current of 23 kHz, for example, is applied from an exciting circuit 275. By this means, part of heat-producing roller 221 is heated by electromagnetic induction.

A temperature sensor 245 comprising a thermistor with a thermal time constant $\tau$ (for example, 3 seconds) is positioned so as to be in contact with the part of the rear surface of fixing belt 220 that has passed the area of contact with heat-producing roller 221. The surface temperature (hereinafter referred to simply as "temperature") of fixing belt 220 is detected by this temperature sensor 245.

The output of temperature sensor 245 that detects the temperature of fixing belt 220 is provided to a control apparatus 279. Also provided to this control apparatus 279, in addition to the output of temperature sensor 245, are the amount of change with respect to the time of temperature detection by temperature sensor 245, the output of a voltage sensor 241 serving as a voltage detection section that monitors the voltage of a power supply 240, and the output of an environmental temperature sensor 242 that detects the temperature of the installation environment of image forming apparatus 117. Based on the outputs of these sensors, control apparatus 279 controls the power supplied to exciting coil 225 via exciting circuit 275 so that an optimal image fixing temperature is attained, and by this means the calorific value of heat-producing roller 221 is controlled.

A coil guide 228 serving as a supporting member is also provided, integral with exciting coil 225 and core 226. This coil guide 228 is formed of a resin with a high heat-resistance temperature such as a PEEK material or PPS. The provision of coil guide 228 makes it possible to confine heat emitted from heat-producing roller 221 to the space between heat-producing roller 221 and exciting coil 225, and prevent damage to exciting coil 225.

Although core 226 shown in FIG. 3 has a semicircular cross-section, core 226 need not necessarily have a shape that follows the shape of exciting coil 225, and may, for example, have an approximately Π-shaped cross-section.

Fixing belt 220 shown in FIG. 3 is, for example, formed as an endless thin belt with a diameter of 50 mm and thickness of 90 μm, with a base material of polyimide resin with a glass transition point of 360° C. The surface of this fixing belt 220 is coated with a 30 μm thick release layer of fluororesin (not shown) to provide releasability. As an alternative to the above-mentioned polyimide resin, a heat-resistant resin such as fluororesin can also be used as the base material of fixing belt 220. It is desirable for the glass transition point of the material of fixing belt 220 to be in a range from 200 to 500° C. Resin or rubber with good releasability such as PTFE, PFA, FEP, silicone rubber, fluororubber, or the like, may be used, alone or mixed, for the release layer on the surface of fixing belt 220. When fixing belt 220 is used as an image heating body for heat-fixing of monochrome images, it is sufficient to secure only releasability, but when fixing belt 220 is used as an image heating body for heat-fixing of color images, it is desirable for elasticity to be provided, and it is necessary to form a thick rubber layer. The calorific value of fixing belt 220 should preferably be 60 J/K or less, and still more preferably 40 J/K or less.

Fixing belt 220 is suspended at predetermined tension on a fixing roller 222 with low thermal conductivity, 30 mm in diameter, made of silicone rubber, an elastic foam material with low surface hardness (here, JISA 30 degrees), for example, and heat-producing roller 221, and can rotate in the direction indicated by the arrow.

Heat-producing roller 221 is, for example, a cylindrical metal roller (here, SUS430) 20 mm in diameter, 320 mm in length, and 0.5 mm thick, with a calorific value of 54 J/K. As an alternative to above-mentioned SUS430, another magnetic metal such as iron can also be used as the material of heat-producing roller 221. The calorific value of heat-producing roller 221 should preferably be 60 J/K or less, and still more preferably 40 J/K or less.

A pressure roller 223 is made of silicone rubber with a hardness of JISA 65 degrees, for example, and forms a nip area by pressing against fixing roller 222 via fixing belt 220. Pressure roller 223 is supported so as to rotate freely when pressing against fixing roller 222 via fixing belt 220. As an alternative to above-mentioned silicone rubber, heat-resistant resin or other rubber such as fluororubber or fluororesin may also be used as the material of pressure roller 223. It is also desirable for the surface of pressure roller 223 to be coated with resin or rubber such as PFA, PTFE, or FEP, alone or mixed, to increase wear resistance and releasability. Furthermore, it is desirable for pressure roller 223 to be made of a material with low thermal conductivity.

Fixing roller 222 is rotated by a drive source (not shown). Pressure roller 223 rotates in a driven fashion in line with the rotation of fixing roller 222 via fixing belt 220. Heat-producing roller 221 rotates in idler fashion in line with the rotation of fixing roller 222 via fixing belt 220.

In fixing apparatus 214 configured in this way, by transporting recording paper 108 onto which toner image 111 has been transferred from the direction indicated by the arrow as shown in FIG. 3 so that the toner image 111 bearing surface of comes into contact with fixing belt 220, toner image 111 can be heat-fixed onto recording paper 108.

The control method used in image forming in the image forming apparatus according to this embodiment will now be described in detail.

In this image forming apparatus, control is performed so that, when the temperature of fixing belt 220 serving as an image heating body reaches or exceeds a preset predetermined temperature following the elapse of a certain time after an image forming operation is started, recording paper 108 is transported to the nip area (fixing area) of fixing apparatus 214, and an image forming operation is started immediately, before the temperature detected by temperature sensor 245 reaches the predetermined image fixing temperature.

This control is performed, for example, in order to correct first print delay due to a temperature difference between the actual temperature of fixing belt 220 of fixing apparatus 214 and the temperature detected by temperature sensor 245 when starting from a cold state.

With this image forming apparatus, the above-described control is performed by predicting the temperature rise time of fixing belt 220 based on the temperature rise rate of fixing belt 220 under certain conditions. Therefore, when the above-described control is performed, it is necessary to exclude cases in which the temperature rise time of fixing belt 220 is significantly different from the prediction.

Thus, in this image forming apparatus, the voltage of power supply 240 is measured by means of voltage sensor 241, and the above-described control is not performed in the case of a low voltage at which the IH (induction heating) output of exciting apparatus 224 falls.

Also, with this image forming apparatus, the temperature of the environment in which image forming apparatus body 117 is installed is measured by means of environmental temperature sensor 242, and the above-described control is not performed in the case of a low temperature requiring a longer time for a rise in temperature of fixing belt 220.

Figure 4:
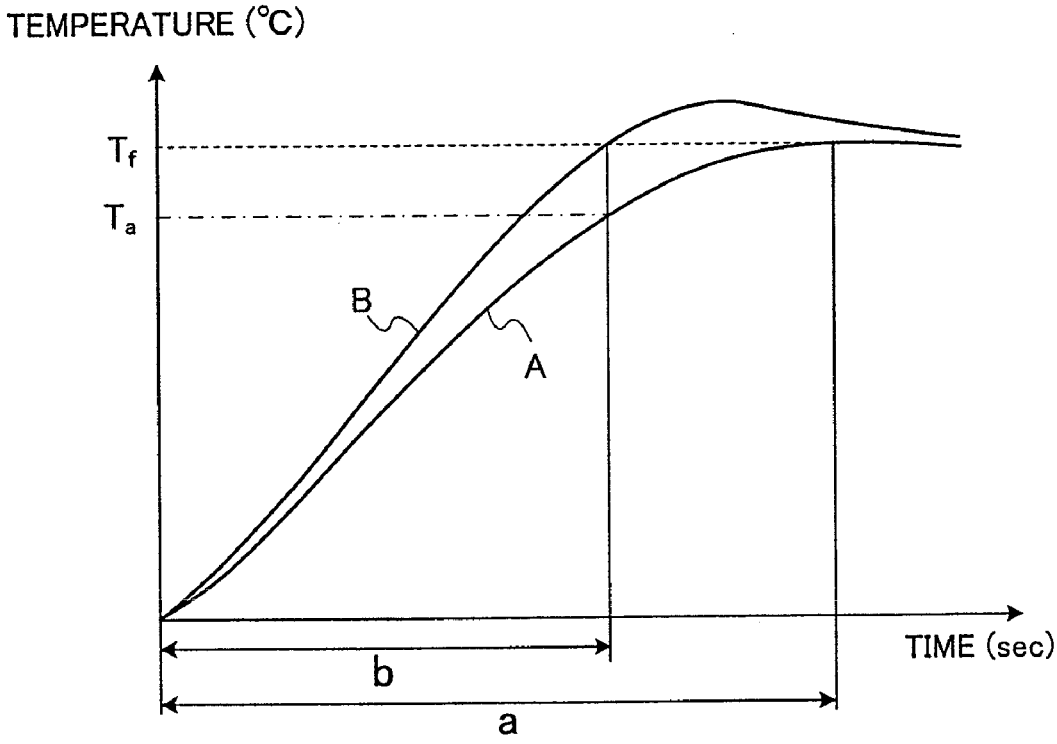
FIG. 4 is a graph showing the surface temperature of a fixing belt and the temperature detected by a temperature sensor in the image forming apparatus according to Embodiment 1.

FIG. 4 is a graph showing the situation when the temperature of fixing belt 220 is raised. In FIG. 4, curve A shows the temperature of fixing belt 220 (hereinafter referred to as "belt temperature") detected by temperature sensor 245, and curve B shows the actual belt temperature of fixing belt 220.

As shown in FIG. 4, the belt temperature detected by temperature sensor 245 is lower than the actual belt temperature of fixing belt 220 because of delayed response due to the large thermal time constant of the thermistor.

Therefore, when fixing apparatus 214 is controlled based on the belt temperature detected by temperature sensor 245, "a" seconds appear to be necessary as the warm-up time until the temperature of fixing belt 220 reaches the optimal image fixing temperature Tf.

However, the actual warm-up time necessary for the temperature of fixing belt 220 to reach optimal image fixing temperature Tf is "b" seconds.

Therefore, in the case of this image forming apparatus, since fixing belt 220 reaches optimal image fixing temperature Tf in "b" seconds, it is possible for toner image 111 to be heat-fixed onto recording paper 108 following the elapse of "b" seconds after heating of fixing belt 220 is started. That is to say, the temperature detected by temperature sensor 245 at which heat-fixing is possible in this case is Ta.

Generally, with this kind of image forming apparatus, it is not possible to provide a wait time until fixing of toner image 111 onto recording paper 108 is completed after an image forming operation is started. Therefore, the start timing of image forming operation must be controlled in order to determine the start timing of an operation that heat-fixes toner image 111 onto recording paper 108.

Thus, in the image forming apparatus according to this embodiment, the following kind of control is performed. This control is explained by the graph shown in FIG. 5.

Figure 5:
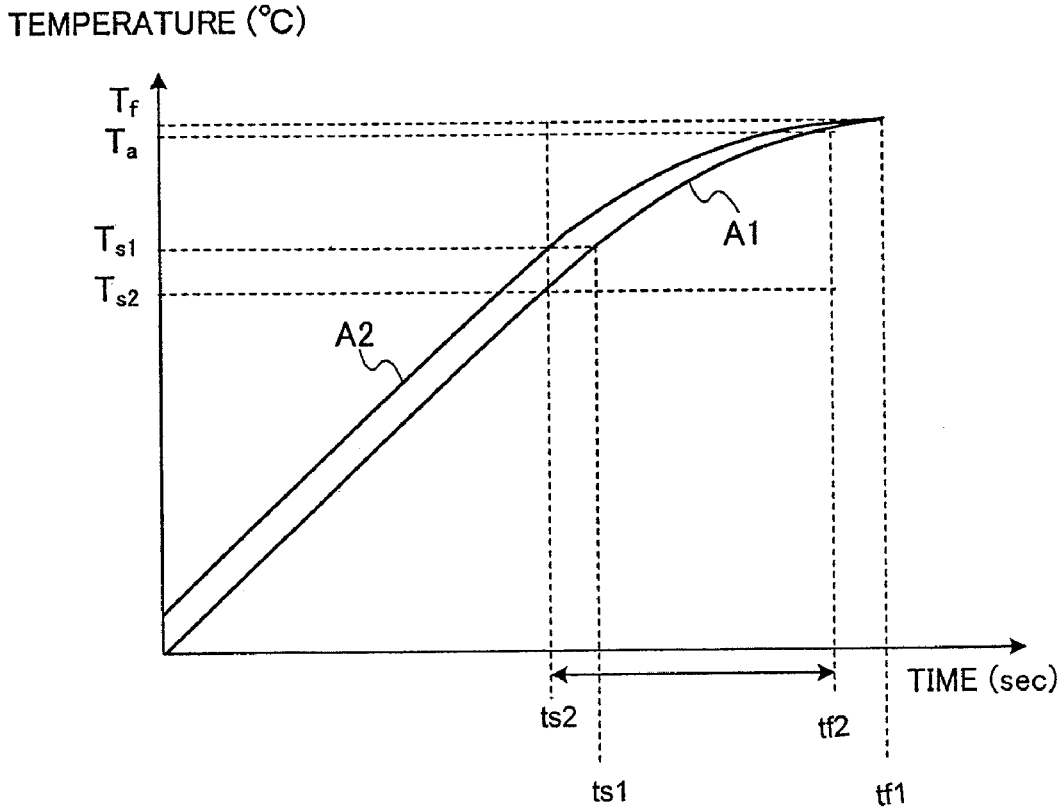
FIG. 5 is a graph showing the relationship between the temperature rise curve of the temperature detected by a temperature sensor and image forming start timing in the image forming apparatus according to Embodiment 1.

In FIG. 5, curve A1 shows the belt temperature detected by temperature sensor 245 when the rise in temperature is slowest within the range of variation of fixing belt 220, and curve A2 shows the belt temperature detected by temperature sensor 245 when the rise in temperature is fastest within the range of variation of fixing belt 220.

Normally, control is performed so that recording paper 108 is transported to the nip area (fixing area) of fixing apparatus 214, and image forming operation is started immediately, when the belt temperature of fixing belt 220 reaches optimal image fixing temperature Tf. Therefore, in FIG. 5, image forming operation should be started at time ts1 obtained by subtracting the time necessary for image forming from point in time tf1 when the rise in temperature is completed. That is to say, control should be performed so that image forming operation is started when the detected value of the belt temperature of fixing belt 220 reaches belt temperature Ts1 at point in time ts1.

However, as described above, if the belt temperature of fixing belt 220 has reached Ta, it is possible to heat-fix toner image 111 onto recording paper 108 (see FIG. 4). That is to say, point in time tf2 can be taken as the time at which recording paper 108 is transported to the fixing area of fixing apparatus 214. Therefore, in this image forming apparatus, if image forming operation is started following the elapse of time ts2 after the start of a rise in temperature of fixing belt 220, recording paper 108 is transported to the fixing area of fixing apparatus 214 when fixing belt 220 reaches the predetermined image fixing temperature.

If the start timing of image forming operation is made Ts2 instead of Ts1, fixing will be started at Ta in any environment. However, the deviation between the belt temperature of fixing belt 220 and the temperature detected by temperature sensor 245 is large when the apparatus is cold, and at other times it is desirable for fixing to be performed at Tf. Thus, in this image forming apparatus, the time from the start of heating of fixing belt 220 of fixing apparatus 214 is measured, and image forming operation is started after the elapse of time ts2 from the start of measurement.

In FIG. 5, if the detected value of the belt temperature is Ts2 at the point at which time ts2 has elapsed from the start of heating of fixing belt 220, the belt temperature can be predicted to have risen to the predetermined image fixing temperature at point in time tf2 after the elapse of the time necessary for image forming from this point in time.

In this case, if image forming operation is started when the belt temperature is less than Ts2 at a point in time after the elapse of time ts2 due to an abnormality of some kind, the temperature of fixing belt 220 will not have risen to the predetermined image fixing temperature when recording paper 108 is transported to the fixing area of fixing apparatus 214. Thus, in this image forming apparatus, the above-described control is not performed if the detected value of the belt temperature has not reached Ts2 or higher at the point at which time ts2 has elapsed after the start of heating of fixing belt 220.

Also, in this image forming apparatus, control is performed so that image forming operation is started when the detected value of the belt temperature reaches image forming start temperature Ts1. Therefore, in this image forming apparatus, if the detected value of the belt temperature is already Ts1 or higher at a point in time following the elapse of ts2 from the start of measurement, image forming operation will already have been started, and it is therefore not necessary to perform the above-described control.

Performing the above kind of control enables the warm-up time of fixing apparatus 214 to be shortened from tf1 to tf2.

Actually, with this image forming apparatus, performing the above-described control enables the first print time to be shortened by 1 to 2 seconds. "First print time" here means the above-described warm-up time plus the time until ejection of recording paper 108 from fixing apparatus 214 ends.

Figure 6:
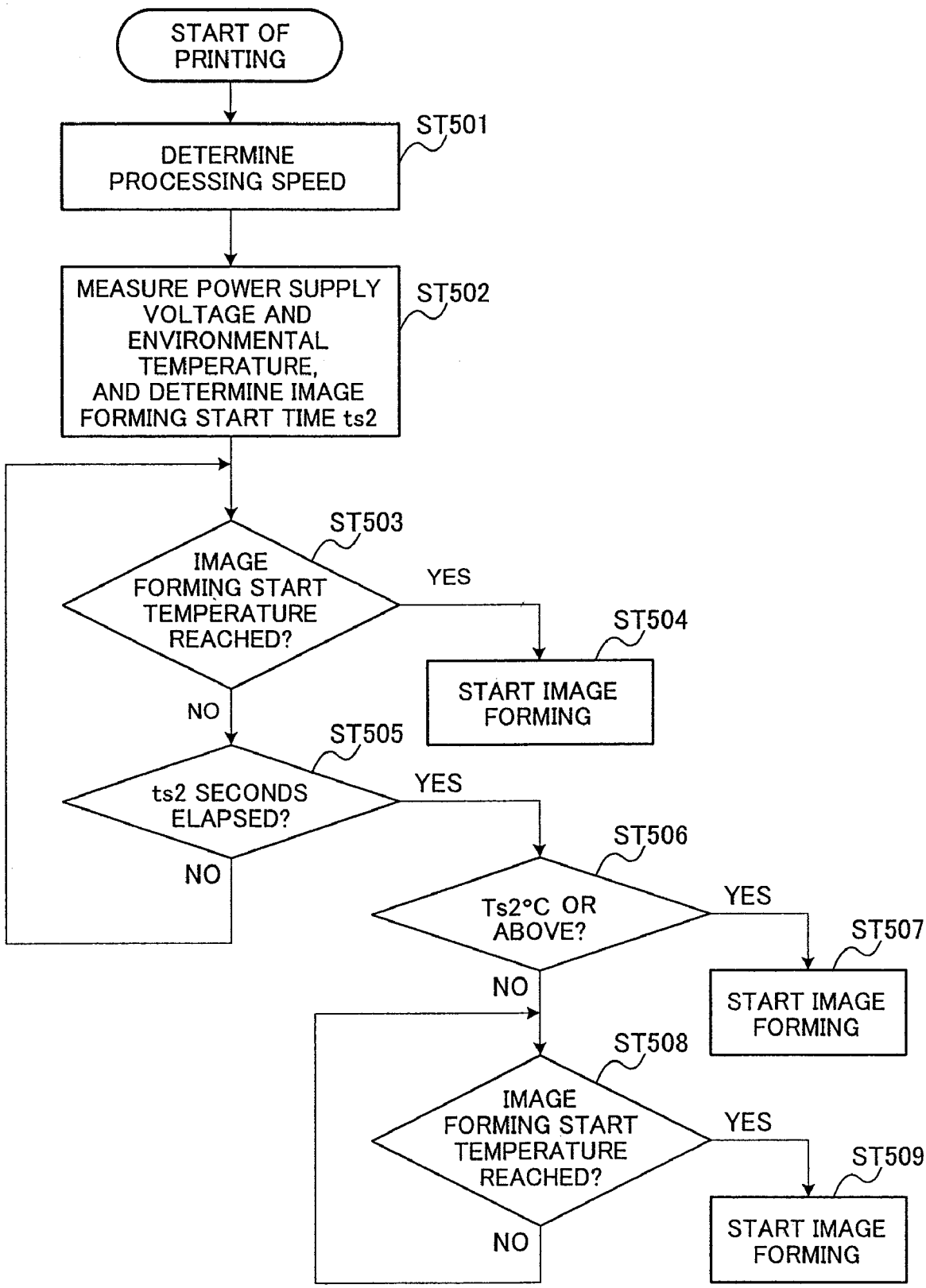
FIG. 6 is a flowchart showing the processing steps in a control routine of a heat-fixing apparatus applied to the image forming apparatus according to Embodiment 1.
Figures 7, 8:
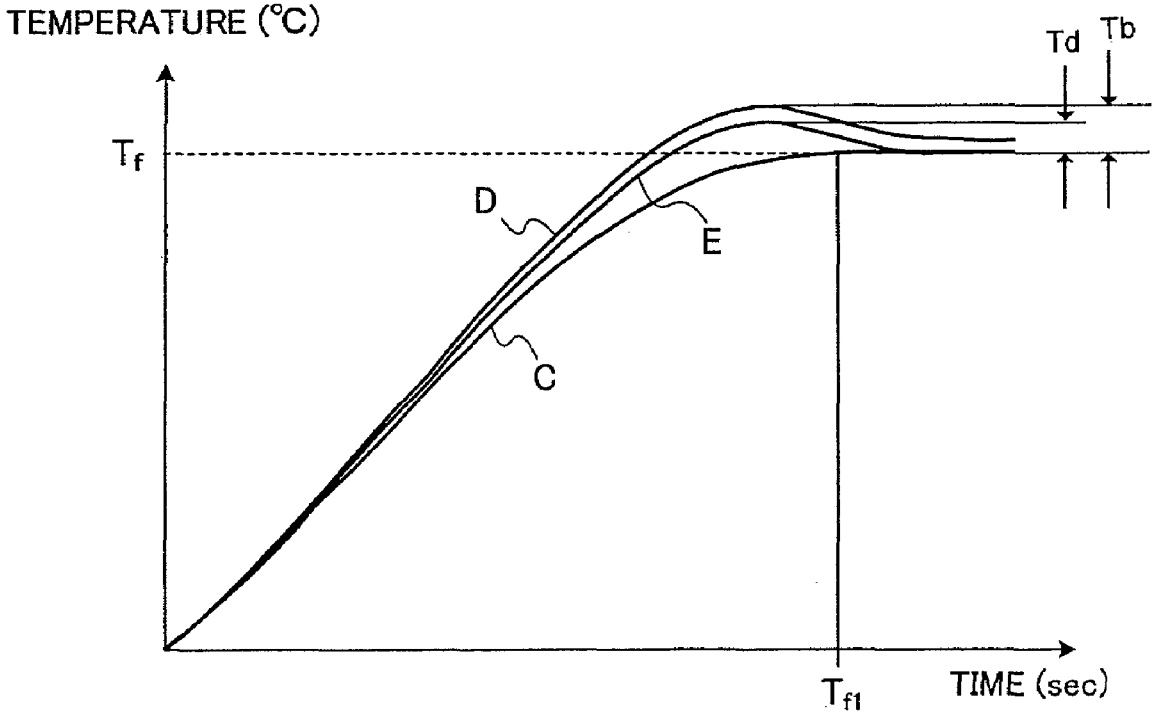
FIG. 7 is a drawing showing an image forming start time environment table in the image forming apparatus according to Embodiment 1.
FIG. 8 is a graph showing the temperature rise situation of a fixing belt according to the presence or absence of the control shown in FIG. 6 in the image forming apparatus according to Embodiment 1.

Control operations in the image forming apparatus according to this embodiment will now be described. FIG. 6 is a flowchart showing the processing steps in a control routine of a fixing apparatus applied to this image forming apparatus. FIG. 7 shows an image forming start time ts2 environment table.

As shown in FIG. 6, when there is a print start request, this image forming apparatus first identifies whether color printing or monochrome printing is to be performed and determines the processing speed (ST501).

Then the power supply voltage and environmental temperature are measured by voltage sensor 241 and environmental temperature sensor 242 respectively, and image forming start time ts2 is determined from the environment table in FIG. 7 (ST502).

Correction is applied to the specified value as shown in the table 1 below according to the power supply voltage measured by voltage sensor 241.

TABLE 1

| Voltage | |
|---|---|
| 95 V or above | No correction |
| 90 V to less than 95 V | +2 seconds |
| Less than 90 V | This control is not applied, and image forming is started according to the belt temperature |

It is then determine whether or not fixing belt 220 has reached the image forming start temperature, based on the temperature detected by temperature sensor 245 (ST503).

If fixing belt 220 has already been warmed up, the temperature of fixing belt 220 will reach the image forming start temperature before the elapse of image forming start time ts2 determined in step ST502. In this case, therefore, image forming is started as soon as the temperature of fixing belt 220 reaches the image forming start temperature (ST504).

On the other hand, if it is determined in step ST503 that the temperature of fixing belt 220 has not reached the image forming start temperature, it is further determined whether or not image forming start time ts2 has elapsed (ST505).

If fixing belt 220 has cooled to close to room temperature (here, 20° C.), image forming start time ts2 will elapse before the image forming start temperature is reached. In this case, therefore, a "YES" determination is made in step ST505, and it is further determined whether or not the belt temperature after the elapse of ts2 is Ts2 or higher (ST506).

If it is determined in this step ST506 that the belt temperature is Ts2 or higher, fixing belt 220 can be considered to have risen in temperature normally, and therefore image forming is started directly (ST507).

On the other hand, if it is determined in step ST506 that the belt temperature is less than Ts2, the temperature rise situation is not normal, and therefore the apparatus waits until the belt temperature reaches the normal image forming start temperature (ST508), and then starts image forming (ST509).

FIG. 8 shows the temperature rise situation of fixing belt 220. In FIG. 8, curve C shows the temperature detected by temperature sensor 245 when the above-described control is performed, curve D shows the belt surface temperature of fixing belt 220 when the above-described control is not performed, and curve E shows the belt surface temperature of fixing belt 220 when the above-described control is performed.

As shown in FIG. 8, in an image forming apparatus according to this embodiment, overshoot Tb from the image fixing temperature when the above-described control is not performed is 10° C. (Tb=10). On the other hand, overshoot Td from the image fixing temperature when the above-described control is performed is kept down to 5° C. (Td=5).

Consequently, in an image forming apparatus according to this embodiment, with regard to the degree of glossiness of a printed sheet after the start of image forming due to overshoot, the glossiness of the first printed sheet with respect to the average value for the first ten printed sheets is around gloss level 5 when the above-described control is performed compared with a gloss level of 10 when the above-described control is not performed.

Thus, in an image forming apparatus according to this embodiment, even when the temperature of fixing belt 220 is detected using an inexpensive temperature sensor 245 with a large thermal time constant, the gloss level due to overshoot of the first printed sheet can be kept low without an increase in the warm-up time.

Embodiment 2

Next, a detailed description will be given of an image forming apparatus according to Embodiment 2 of the present invention.

Figure 9:
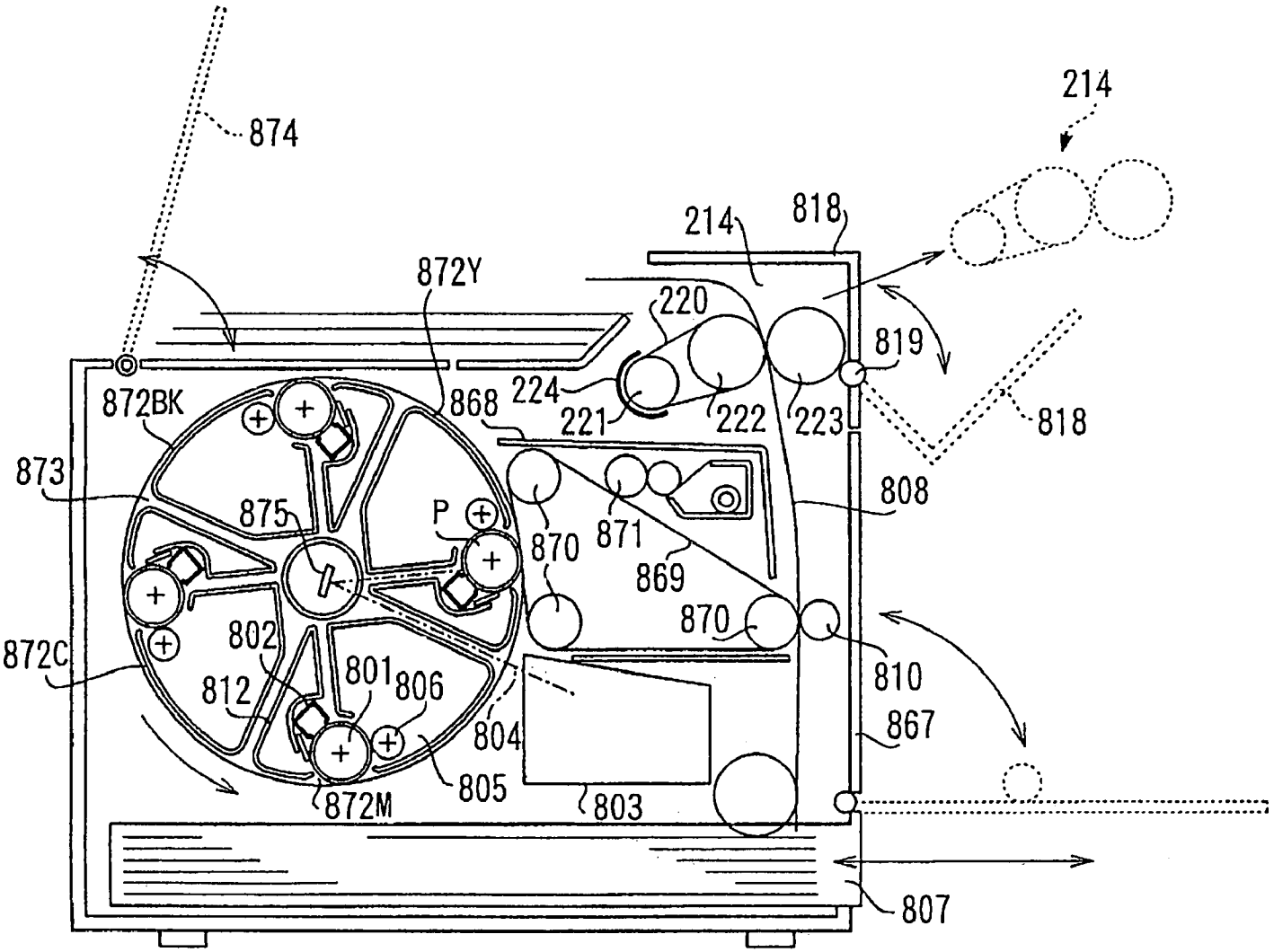
FIG. 9 is a schematic diagram showing the overall configuration of an image forming apparatus according to Embodiment 2 of the present invention.

FIG. 9 is a schematic diagram showing the overall configuration of an image forming apparatus (color image forming apparatus) according to Embodiment 2 of the present invention.

As shown in FIG. 9, with this color image forming apparatus, opening a front door 867 attached to the front surface (the right-hand in FIG. 9) enables a transfer belt unit 868 to be inserted into and removed from the body of the apparatus. This transfer belt unit 868 is composed of an intermediate transfer belt 869, three supporting spindles 870 on which this intermediate transfer belt 869 is suspended, a cleaner 871, and so forth.

On the left inside this color image forming apparatus there is installed, next to transfer belt unit 868, a tubular carriage 873 supported axially so as to be able to rotate in the direction indicated by the arrow. Inside this carriage 873 there are housed in a circular arrangement four image forming units 872BK, 872C, 872M, and 872Y with an approximately fan-shaped cross-section for black (BK), cyan (C), magenta (M), and yellow (Y) respectively.

Each of image forming units 872BK, 872C, 872M, and 872Y has an integral configuration comprising processing elements including a corona charger 802, developing unit 805, and cleaning apparatus 812 arranged around a photosensitive drum 801.

Corona charger 802 is configured so as to negatively charge photosensitive drum 801 uniformly.

Developing units 805 hold black, cyan, magenta, and yellow toners with a negative electrostatic property respectively. These toners are made to adhere to an electrostatic latent image on photosensitive drum 801 opposite each developing unit 805 by means of a developing roller 806. By this means, toner images of each color are formed on photosensitive drums 801.

Below transfer belt unit 868 is located a laser beam scanner 803 that irradiates the surface of photosensitive drum 801 with a laser beam 804.

Image forming units 872BK, 872C, 872M, and 872Y can be inserted into and removed from the body of the image forming apparatus by opening a top door 874 in the upper surface of the color image forming apparatus.

In FIG. 9, when carriage 873 rotates, image forming units 872BK, 872C, 872M, and 872Y rotate around a non-rotating mirror 875. During image forming, image forming units 872BK, 872C, 872M, and 872Y are positioned sequentially at image forming position P opposite intermediate transfer belt 869.

The operation of this color image forming apparatus will now be described in detail.

First, as shown in FIG. 9, carriage 873 is rotated and image forming unit 872Y for the first color, yellow, is moved to image forming position P. In this state, the surface of photosensitive drum 801 is uniformly negatively charged by corona charger 802.

Then, the surface of photosensitive drum 801 is irradiated by laser beam 804 from laser beam scanner 803. This laser beam 804 passes between yellow image forming unit 872Y and magenta image forming unit 872M, is reflected by mirror 875, and is incident on photosensitive drum 801 at image forming position P. By this means, an electrostatic latent image is formed on photosensitive drum 801.

This electrostatic latent image on photosensitive drum 801 is developed by means of yellow toner transported by developing roller 806 of developing unit 805 of yellow image forming unit 872Y opposite to photosensitive drum 801. By this means, a yellow toner image is formed on photosensitive drum 801.

The yellow toner image formed on photosensitive drum 801 by yellow image forming unit 872Y in this way undergoes primary transfer to intermediate transfer belt 869.

Then, after primary transfer of the yellow toner image to intermediate transfer belt 869, carriage 873 is rotated through 90 degrees in the direction indicated by the arrow, and magenta image forming unit 872M is moved to image forming position P.

In this state, the same operations are performed as in the case of yellow described above, and a magenta toner image is superimposed on the yellow toner image that has undergone primary transfer to intermediate transfer belt 869.

Similar operations are then executed in turn for the remaining cyan and black image forming units 872C and 872BK. By this means, a full-color toner image in which toner images of four colors are superimposed is formed on intermediate transfer belt 869.

Then, a transfer roller 810 is brought into contact with intermediate transfer belt 869, with the timing coordinated with the front position of the fourth-color, black, toner image on intermediate transfer belt 869.

Meanwhile, recording paper 808 is transported from a paper feed section 807 to the transfer nip area between transfer roller 810 and intermediate transfer belt 869. Then, blanket transfer (secondary transfer) of the four-color full-color toner image on intermediate transfer belt 869 is performed to recording paper 808 transported to this transfer nip area.

The secondary-transferred full-color toner image on recording paper 808 is heat-fixed on passing through fixing apparatus 214, after which recording paper 808 is ejected from the body of the apparatus. Residual toner remaining on intermediate transfer belt 869 at the time of secondary transfer is removed from intermediate transfer belt 869 by cleaner 871 that detaches from intermediate transfer belt 869 at coordinated timing.

When image forming is completed on first printed sheet in this way, yellow image forming unit 872Y again moves to image forming position P, and prepares for the next image forming operation.

Fixing belt 220 of the image forming apparatus according to this embodiment is composed of a 150 μm thick silicone rubber layer on a 90 μm thick polyimide resin base material. This fixing belt 220 is configured so that its direction of tensioning coincides with the insertion/removal direction of fixing apparatus 214.

As shown in FIG. 9, fixing apparatus 214 of the image forming apparatus according to this embodiment is configured so that heat-producing roller 221, fixing roller 222, and pressure roller 223 can be inserted into and removed from the body of the image forming apparatus as an integral unit, leaving only exciting apparatus 224 inside the body of the apparatus.

This fixing apparatus 214 is configured so that the direction of tensioning of fixing belt 220, the aperture direction of exciting apparatus 224 with an approximately semicircular cross-section, and its own insertion/removal direction coincide. By this means, exciting apparatus 224 and heat-producing roller 221 do not cause interference when fixing apparatus 214 is inserted into or removed from the body of the apparatus, and fixing apparatus 214 can easily be inserted into and removed from the body of the apparatus. Insertion and removal of fixing apparatus 214 is carried out by means of the opening and closing of a fixing door 818 on a hinge 819.

In the image forming apparatus according to either of the above-described embodiments, heat-producing roller 221 is made to produce heat by electromagnetic induction, and fixing belt 220 is heated indirectly. However, the present invention is not necessarily limited to this configuration, and it is also possible, for example, for a belt that has electrical conductivity to be used as fixing belt 220, and for fixing belt 220 to be heated directly by electromagnetic induction. A belt that could be used for such an electrically conductive fixing belt might have, for example, a 150 μm silicone rubber layer for fixing a color image coating the surface of a 30 μm thick, 60 mm diameter nickel type belt material.

Also, the image forming apparatus according to either of the above-described embodiments is provided with a cover (not shown) for making the temperature of fixing belt 220 detected by temperature sensor 245 and the ambient temperature in the vicinity of temperature sensor 245 approximately coincide. This cover is normally attached to the fixing apparatus 214 side, but a configuration may also be used in which this cover is provided on the image forming apparatus side so that when fixing apparatus 214 is inserted into the body of the image forming apparatus, at least a part of fixing belt 220 covers the space occupied by temperature sensor 245 and pressure roller 223.

Furthermore, in the image forming apparatus according to either of the above-described embodiments, heat-fixing of a toner image onto recording paper 108 or 808 is started at predetermined timing before the belt temperature of fixing belt 220 detected by temperature sensor 245 reaches a predetermined image fixing temperature.

Therefore, according to this image forming apparatus, even though the temperature of fixing belt 220 is detected by means of an inexpensive temperature sensor 245 with a large thermal time constant, first print start time delay due to a delay in the response of temperature sensor 245 is eliminated, and therefore the first print time can be shortened, and the glossiness of the first printed sheet is no longer abnormally high.

Also, the sensor used as temperature sensor 245 in this image forming apparatus has a thermal time constant $\tau$ of 1/20 or more of the warm-up time necessary for fixing belt 220 to rise in temperature from room temperature to a predetermined temperature.

Here, thermal time constant $\tau$ denotes the time necessary for the temperature of temperature sensor 245 to change by 63.2% of the temperature difference between the initial temperature (room temperature) and a predetermined temperature (fixing temperature) when the ambient temperature of temperature sensor 245 is changed rapidly in a zero-load state.

When the calorific value of heat-producing roller 221 is controlled based on the temperature detected by temperature sensor 245 so that the temperature of fixing belt 220 becomes a predetermined image fixing temperature, the calorific value of heat-producing roller 221 is progressively reduced as the temperature of fixing belt 220 approaches the predetermined image fixing temperature. In this case, if thermal time constant $\tau$ of temperature sensor 245 is large, it takes time for the temperature of heat-producing roller 221 and the temperature detected by temperature sensor 245 to become approximately equal. Therefore, when temperature control of fixing belt 220 is performed by temperature sensor 245 with a large thermal time constant $\tau$, overshoot is large as described above, the belt temperature detected by temperature sensor 245 is lower than the actual temperature of fixing belt 220, the glossiness of the first printed sheet is high, and the first print time is long.

In this image forming apparatus, since heat-fixing of a toner image onto recording paper 108 or 808 is started before the temperature detected by temperature sensor 245 reaches the predetermined image fixing temperature, heat-fixing at the predetermined image fixing temperature is possible, and overshoot can be kept small, even if thermal time constant $\tau$ of temperature sensor 245 is a large 1/20 or more of the warm-up time.

Therefore, according to this image forming apparatus, the temperature of fixing belt 220 can be controlled to an appropriate temperature using an inexpensive temperature sensor 245 with a large thermal time constant $\tau$ of 1/20 or more of the warm-up time, and a low-cost fixing apparatus 214 can be provided.

Also, according to this image forming apparatus, fixing belt 220 comprises an electrically conductive belt at least part of which has electrical conductivity, and heat-producing roller 221 is heated directly by means of exciting apparatus 224 using IH type electromagnetic induction. Alternatively, heat-producing roller 221 is configured so as to be in internal contact with fixing belt 220 at least part of which has electrical conductivity, and directly heats this fixing belt 220.

Therefore, according to this image forming apparatus, fixing belt 220 can be directly or indirectly heated by means of electromagnetic induction of exciting apparatus 224, and a fixing apparatus 214 with a short warm-up time can be provided that enables the temperature rise time of fixing belt 220 to be greatly reduced without any trouble. In the case of a configuration whereby fixing belt 220 is heated indirectly by heat-producing roller 221, in particular, fixing belt 220 can be configured as a heat-resistant resin belt and heat-producing roller 221 can be configured as a metal roller, enabling fixing apparatus 214 to be configured simply and inexpensively.

In this image forming apparatus, on the basis of the temperature detected by temperature sensor 245, image forming operation can be started based on the timing at which the temperature rises to the normal image fixing temperature, or the timing at which a predetermined time has elapsed after the start of heating of fixing belt 220, whichever timing is earlier.

That is to say, in this image forming apparatus, when fixing apparatus 214 has already warmed up and there is little overshoot, fixing belt 220 reaches the image fixing temperature first, and therefore heat-fixing of a toner image onto recording paper 108 or 808 is started at the timing at which fixing belt 220 rises in temperature to the predetermined image fixing temperature.

On the other hand, if the temperature of fixing belt 220 has not reached the predetermined image fixing temperature despite the elapse of a preset predetermined time, fixing apparatus 214 is probably in a cold state, and overshoot can be determined to be large. Thus, in this case, image forming operation is started immediately, and heat-fixing of a toner image onto recording paper 108 or 808 is started just before fixing belt 220 reaches the predetermined image fixing temperature. Here, the above-mentioned predetermined time is decided upon by finding the rate of rise in temperature of fixing belt 220 beforehand by experimentation.

With this image forming apparatus, it is possible for image forming operation to be started immediately only when the temperature of fixing belt 220 following the elapse of a predetermined time after the start of operation of fixing apparatus 214 is a temperature within a predetermined range.

If the temperature of fixing belt 220 has only risen to a temperature lower than the temperature predicted beforehand for some reason or other, as described above, cold offset occurs. In this image forming apparatus, since image forming operation is started immediately only when the temperature of fixing belt 220 following the elapse of a predetermined time after the start of operation of fixing apparatus 214 is a temperature within a predetermined range, optimal fixing can be performed without the occurrence of cold offset even in the event of a deficient rise in temperature of fixing belt 220 due to an unforeseen fault.

With this image forming apparatus, a configuration can be used whereby image forming operation is started only when the power supply voltage at the time of the start of image forming detected by voltage sensor 241 is greater than or equal to a predetermined voltage. Also, with this image forming apparatus, it is possible to change the predetermined time from the start of operation of fixing apparatus 214 until the start of image forming operation according to the power supply voltage detected by voltage sensor 241.

If the above-mentioned power supply voltage is less than or equal to a predetermined voltage, heat-producing roller 221 is not made to produce sufficient heat, and the temperature of fixing belt 220 cannot reach the predicted temperature, with the result that cold offset occurs.

With this image forming apparatus, since it is possible for image forming operation to be started only when the power supply voltage at the time of the start of image forming detected by voltage sensor 241 is greater than or equal to a predetermined voltage, the above-described occurrence of cold offset can be prevented. It is also possible to take measures so that the predetermined time until the start of image forming is changed according to the degree of decrease of the power supply voltage, and cold offset does not occur.

With this image forming apparatus, a configuration can be used whereby image forming operation is started only when the environmental temperature at the time of the start of image forming detected by environmental temperature sensor 242 is greater than or equal to a predetermined temperature. Also, with this image forming apparatus, it is possible to change the predetermined time from the start of operation of fixing apparatus 214 until the start of image forming operation according to the environmental temperature detected by environmental temperature sensor 242.

With this image forming apparatus, since it is possible for image forming operation to be started following the elapse of a predetermined time after the start of operation of fixing apparatus 214 only when the environmental temperature is greater than or equal to a predetermined temperature, image forming operation can be started after the temperature of fixing belt 220 reaches a predetermined image fixing temperature. It is also possible to take measures so that the time until the start of image forming is changed according to the degree of decrease of the environmental temperature, and cold offset does not occur.

With this image forming apparatus, the above-mentioned predetermined time can be changed according to the processing speed of the image forming apparatus. Therefore, according to this image forming apparatus, the heating time of fixing belt 220 can be controlled in accordance with the processing speed, enabling optimal heat-fixing of a toner image onto recording paper 108 or 808 to be performed.

With this image forming apparatus, the calorific value of heat-producing roller 221 is controlled based on the temperature detected by temperature sensor 245 so that the temperature of fixing belt 220 is maintained at an image fixing temperature suitable for heat-fixing an unfixed toner image onto recording paper 108 or 808 comprising plain paper.

Therefore, according to this image forming apparatus, since control is performed so that the temperature of fixing belt 220 is maintained at an image fixing temperature suitable for plain paper, which is generally the most frequently used, the effects of enabling the first print time to be shortened and printing defects to be prevented for the first printed sheet are displayed more conspicuously.

With this image forming apparatus, overshoot can be kept small even when the image heating body is configured as fixing belt 220 comprising a belt-shaped member with a short warm-up time, enabling temperature sensor 245 with a large thermal time constant, of the same kind as in a conventional fixing apparatus, to be used without any trouble.

With this image forming apparatus, temperature sensor 245 comprises at least a temperature measuring element that detects the temperature of fixing belt 220 and a nonmetallic elastic body that supports this temperature measuring element and is in contact with fixing belt 220 at low pressure.

By making the elastic body that supports the temperature measuring element nonmetallic in this way, this elastic body does not produce heat directly through electromagnetic induction even though an induction heating type heat-producing section is used. Therefore, according to this image forming apparatus, the temperature of fixing belt 220 can be measured accurately by the temperature measuring element of temperature sensor 245, unaffected by the installation location of temperature sensor 245.

With this image forming apparatus, the elastic body supporting the temperature measuring element described above is a sponge of low thermal capacity, and therefore this elastic body is not susceptible to induction heating, and flexibility with regard to the installation location of temperature sensor 245 is further increased.

With this image forming apparatus, the above-described temperature measuring element is a thermistor, and therefore, compared with a thermocouple, for example, temperature sensor 245 is less expensive and more durable and has greater detection precision, and the reliability of fixing apparatus 214 is improved.

According to the above-described image forming method, an image forming method can be implemented that is suitable for an image forming apparatus provided with fixing apparatus 214 in which temperature sensor 245 with a large thermal time constant is used and fixing belt 220 is heated rapidly.

(1) Thus, an image forming apparatus of the present invention has an image forming section that forms and holds an unfixed toner image on a recording medium fed to an image forming area, and a heat-fixing apparatus that heats the recording medium transported from the image forming area in a predetermined fixing area and fixes the unfixed toner image onto the recording medium; wherein the aforementioned heat-fixing apparatus has an image heating body that heats the unfixed toner image on the recording medium, a heat-producing section that heats the aforementioned image heating body, a temperature sensor that detects the temperature of the aforementioned image heating body, and a calorific value control section that controls the calorific value of the aforementioned heat-producing section based on the temperature detected by the aforementioned temperature sensor so that the temperature of the aforementioned image heating body is maintained at an image fixing temperature suitable for heat-fixing the unfixed toner image onto the recording medium; and that image forming apparatus has an image forming operation control section that controls image forming operation of the aforementioned image forming section so that heat-fixing of the unfixed toner image onto the recording medium is started at predetermined timing before the temperature detected by the aforementioned temperature sensor reaches the aforementioned image fixing temperature.

As described above, a halogen lamp or electric heating coil generally used as the heat-producing section of a conventional heat-fixing apparatus requires a long time to raise the temperature of an image heating body to the image fixing temperature. Consequently, with this kind of heat-fixing apparatus, the thermal time constant of the temperature sensor has not been a problem. However, with an IH (induction heating) type of heat-fixing apparatus in which the image heating body is heated directly by electromagnetic induction of an excitation section, the warm-up time is short and the temperature rise time of the image heating body is greatly shortened, with the result that the thermal time constant of the temperature sensor can no longer be ignored. Thus, in the above-described configuration, image forming operation control section is provided, and image forming operation of the image forming section is controlled so that heat-fixing of an unfixed toner image onto the recording medium is started at predetermined timing before the temperature detected by the temperature sensor reaches the predetermined image fixing temperature. According to this configuration, even though the temperature of the image heating body is detected using an inexpensive temperature sensor with a large thermal time constant, there is no longer any first print start time delay due to the slow response of the temperature sensor, and even the first printed sheet is printed normally without its glossiness being abnormally high. Here, "predetermined timing" means the timing at which the actual temperature of the image heating body reaches the image fixing temperature. One method of specifying this timing is to measure and specify the timing at which the image heating body reaches the actual image fixing temperature from the temperature detected by the temperature sensor, based on the rate of rise in temperature during heating of the image heating body. Another method is to measure and specify the timing at which the image heating body reaches the actual image fixing temperature from the elapsed time after the start of heating of the image heating body, based on the rate of rise in temperature during heating of the image heating body.

(2) The image forming apparatus of the present invention has a configuration wherein, in the invention described in (1) above, the thermal time constant of the aforementioned temperature sensor is 1/20 or more of the warm-up time necessary for the temperature of the aforementioned image heating body to rise to the aforementioned image fixing temperature.

The inventors making the present application conducted an experiment to examine the relationship between the thermal time constant of a temperature sensor and the phenomena of the delay of the first print start time and the glossiness of the first printed sheet being abnormally high. As a result of this experiment, it was found that the above-described phenomena occurred when using a temperature sensor with a thermal time constant of 1/20 or more of the time required for the temperature of the image heating body to rise from room temperature (here assumed to be 20° C.) to the image fixing temperature (the warm-up time). Also, these phenomena were conspicuous when using a temperature sensor with a thermal time constant of 1/10 or more of the warm-up time. That is to say, when a temperature sensor with a thermal time constant of 1.5 seconds was used in a heat-fixing apparatus with a warm-up time of 30 seconds, for example, overshoot was large, and when a temperature sensor with a thermal time constant of 3 seconds was used, conspicuous overshoot and an increase in the glossiness of the first printed sheet were observed. With this configuration, since heat-fixing of an unfixed toner image onto the recording medium is started before the temperature detected by the temperature sensor reaches the predetermined image fixing temperature, even if the thermal time constant of the temperature sensor is a large value of 1/20 or more of the warm-up time, heat-fixing at the predetermined image fixing temperature is still possible, and it is also possible to suppress overshoot to a low level. Therefore, according to this configuration, a low-cost heat-fixing apparatus can be provided that, in addition to obtaining the effects of the invention described in (1) above, enables the temperature of the image heating body to be controlled to suitable temperature using an inexpensive temperature sensor with a large thermal time constant of 1/20 or more of the warm-up time.

(3) The image forming apparatus of the present invention has a configuration wherein, in the invention described in (1) above, at least part of the aforementioned image heating body has electrical conductivity, and the aforementioned heat-producing section has an excitation section that heats the aforementioned image heating body directly by means of electromagnetic induction.

With this configuration, even in the case of a heat-fixing apparatus in which an image heating body is heated rapidly as with the IH method, a temperature sensor with a large thermal time constant, of the same kind as in a conventional fixing apparatus, can be used without any trouble. Therefore, according to this configuration, a heat-fixing apparatus with a short warm-up time can be provided that, in addition to obtaining the effects of the invention described in (1) above, enables an image heating body to be heated directly by means of electromagnetic induction of an excitation section, and enables the temperature rise time of the image heating body to be greatly shortened without any trouble.

(4) The image forming apparatus of the present invention has a configuration wherein, in the invention described in (1) above, the aforementioned heat-producing section has a rotatable heat-producing member at least part of which has electrical conductivity and is in contact with the aforementioned image heating body and heats the aforementioned image heating body indirectly, and an excitation section that heats the aforementioned heat-producing member by means of electromagnetic induction.

With this configuration, since the image heating body is heated indirectly by the heat-producing member, it is possible, for example, for the image heating body to be configured as a heat-resistant resin belt, and for the heat-producing member to be configured as a metal roller. Therefore, according to this configuration, in addition to obtaining the effects of the invention described in (1) above, it is possible to configure a heat-fixing apparatus inexpensively and simply.

(5) The image forming apparatus of the present invention has a configuration wherein, in the invention described in (1) above, the aforementioned image forming operation control section starts the image forming operation by the aforementioned image forming section based on the timing at which the temperature of the aforementioned image heating body reaches a predetermined temperature, or the timing at which the elapsed time after the start of operation of the aforementioned heat-fixing apparatus reaches a predetermined time, whichever timing is earlier.

As described above, with this configuration, heat-fixing of an unfixed toner image onto a recording medium is started when the image heating body reaches a predetermined image fixing temperature, that is, just before the temperature detected by the temperature sensor reaches the aforementioned fixing temperature. By this means, it is possible to prevent the actual fixing temperature of the image heating body from rising and overshoot from increasing. Also, when a recording medium is transported to the fixing area of the heat-fixing apparatus, heat of the image heating body is lost to this recording medium, and therefore overshoot is reduced. There are two methods of starting image forming operation of the image forming section without increasing overshoot, as follows. The first method is to predict the rate of rise in temperature of the image heating body, and start image forming operation from the temperature detected by the temperature sensor so that transportation of the recording medium can be started just before the image fixing temperature. The second method is to similarly predict the rate of rise in temperature of the image heating body, and start image forming operation after a predetermined time has elapsed since the start of operation of the heat-fixing apparatus. Normally, it is not possible to provide a wait time until heat-fixing of an unfixed toner image onto the recording medium is completed after the start of image forming operation. Therefore, the timing at which the recording medium is transported to the fixing area of the heat-fixing apparatus is determined by the start timing of the image forming operation. Here, with the method whereby image forming operation is started at timing earlier than the timing at which the temperature of the image heating body rises to the predetermined image fixing temperature, based on the temperature detected by the temperature sensor, transportation of the recording medium to the fixing area is always started before the temperature of the image heating body rises to the image fixing temperature, regardless of the initial temperature state before heating of the image heating body. The thermal time constant of the temperature sensor becomes larger if the temperature of the temperature sensor itself is low, and becomes smaller if the temperature sensor itself has already been heated to a temperature of a certain level. Thus, overshoot is larger if the heat-fixing apparatus is cool, and overshoot is smaller if heat-fixing apparatus is already warmed up to a temperature of a certain level. Therefore, with this heat-fixing apparatus, it is desirable for transportation of the recording medium to be started after the actual temperature of the image heating body has risen to the predetermined image fixing temperature. With this configuration, image forming operation of the image forming section is started based on the timing at which the temperature of the image heating body rises to the predetermined image fixing temperature and reaches the image forming start temperature, or the timing at which the elapsed time after the start of operation of the heat-fixing apparatus reaches a predetermined time, whichever timing is earlier. That is to say, when the heat-fixing apparatus has already been warmed up and overshoot is small, the temperature of the image heating body reaches the image forming start temperature before the timing at which the elapsed time after the start of operation of the heat-fixing apparatus reaches a predetermined time. Therefore, in this case, the recording medium is transported to the fixing area in a state in which the temperature of the image heating body has risen to the predetermined image fixing temperature. On the other hand, if the temperature of the image heating body has not reached the predetermined image fixing temperature despite the elapse of the predetermined time, the heat-fixing apparatus is probably in a cold state. Thus, in this case, overshoot can be determined to be large, and therefore image forming operation is started immediately. By this means, the recording medium can be transported to the fixing area just before the image heating body reaches the predetermined image fixing temperature. The aforementioned predetermined time is decided upon by finding the rate of rise in temperature of the image heating body beforehand by experimentation. Thus, according to this configuration, in addition to obtaining the effects of the invention described in (1) above, it is possible to start image forming operation in accordance with the actual heating state of the image heating body, enabling image forming operation for the first printed sheet to be started at timing that allows printing to be performed in the shortest time regardless of the heating state.

(6) The image forming apparatus of the present invention has a configuration wherein, in the invention described in (1) above, the aforementioned image forming operation control section starts the image forming operation by the aforementioned image forming section only when the temperature of the aforementioned image heating body following the elapse of a predetermined time after the start of operation of the aforementioned heat-fixing apparatus is a temperature within a predetermined range.

As described above, if image forming operation is started at the point in time when a predetermined time has elapsed after the start of operation of the heat-fixing apparatus, the recording medium can be transported to the fixing area just before the image heating body reaches the predetermined image fixing temperature. However, if the temperature of the image heating body has only risen at a lower rate of rise in temperature than the predicted rate of rise in temperature for some reason or other, cold offset occurs at the time of heat-fixing of an unfixed toner image onto the recording medium. With this configuration, image forming operation is started only when the temperature of the image heating body has risen to the lowest temperature predicted at a point in time after the elapse of the predetermined time. Also, with this configuration, image forming operation is also started immediately when the temperature of the image heating body reaches the image forming start temperature at a point in time after the elapse of the predetermined time. In actuality, image forming operation is started immediately when the temperature of the image heating body is within a temperature range greater than or equal to the lowest temperature predicted and less than or equal to the image forming start temperature at a point in time after the elapse of the predetermined time. Thus, according to this configuration, in addition to obtaining the effects of the invention described in (1) above, it is possible for optimal heat-fixing of an unfixed toner image onto the recording medium to be performed without the occurrence of cold offset even in the event of a deficient rise in temperature of the image heating body due to an unforeseen fault.

(7) The image forming apparatus of the present invention has a configuration wherein, in the invention described in (1) above, a voltage detecting section that detects the power supply voltage is further provided, and the aforementioned image forming operation control section starts the image forming operation by the aforementioned image forming section following the elapse of a predetermined time after the start of operation of the aforementioned heat-fixing apparatus only when the power supply voltage detected by the aforementioned voltage detecting section at the time of the start of the image forming operation of the aforementioned image forming section is greater than or equal to a predetermined voltage.

If the power supply voltage is less than or equal to the predetermined voltage, the heat-producing section cannot heat the image heating body sufficiently, and the temperature of the image heating body cannot reach the predicted temperature. With this configuration, image forming operation of the image forming section is started following the elapse of a predetermined time after the start of operation of the heat-fixing apparatus only when the power supply voltage at the time of the start of image forming operation is greater than or equal to a predetermined voltage. Therefore, according to this configuration, in addition to obtaining the effects of the invention described in (1) above, a state is established in which the temperature of the image heating body is sufficiently heated to the predicted temperature, and it is possible for optimal heat-fixing of an unfixed toner image onto the recording medium to be performed.

(8) The image forming apparatus of the present invention has a configuration wherein, in the invention described in (1) above, a voltage detecting section that detects the power supply voltage is further provided, and the aforementioned image forming operation control section changes the predetermined time until the image forming operation of the aforementioned image forming section is started after the aforementioned heat-fixing apparatus starts operating in accordance with the power supply voltage detected by the aforementioned voltage detecting section at the time of the start of the image forming operation of the aforementioned image forming section.

According to this configuration, since the predetermined time until image forming operation is started can be changed in accordance with the degree of decrease of the power supply voltage detected by the voltage detecting section, it is possible for measures to be taken so that cold offset does not occur. In this case, it is possible to change the aforementioned predetermined time at a predetermined rate of change in accordance with the power supply voltage detected by the voltage detecting section, or to change the aforementioned predetermined time by preparing a power supply voltage table.

(9) The image forming apparatus of the present invention has a configuration wherein, in the invention described in (1) above, an environmental temperature sensor that detects the environmental temperature of the body of the image forming apparatus is further provided, and the aforementioned image forming operation control section starts the image forming operation of the aforementioned image forming section following the elapse of a predetermined time after the start of operation of the aforementioned heat-fixing apparatus only when the environmental temperature detected by the aforementioned environmental temperature sensor at the time of the start of the image forming operation of the aforementioned image forming section is greater than or equal to a preset predetermined temperature.

According to this configuration, if the environmental temperature of the body of the image forming apparatus is low, the heat-producing section cannot heat the image heating body sufficiently, and the temperature of the image heating body cannot reach the predicted temperature. With this configuration, image forming operation of the image forming section is started following the elapse of a predetermined time after the start of operation of the heat-fixing apparatus only when the environmental temperature of the body of the image forming apparatus is greater than or equal to a predetermined temperature. Therefore, according to this configuration, in addition to obtaining the effects of the invention described in (1) above, a state is established in which the temperature of the image heating body is sufficiently heated to the predicted temperature, and it is possible for optimal heat-fixing of an unfixed toner image onto the recording medium to be performed.

(10) The image forming apparatus of the present invention has a configuration wherein, in the invention described in (1) above, an environmental temperature sensor that detects the environmental temperature of the body of the image forming apparatus is further provided, and the aforementioned image forming operation control section changes the predetermined time until the image forming operation of the aforementioned image forming section is started after the aforementioned heat-fixing apparatus starts operating in accordance with the environmental temperature detected by the aforementioned environmental temperature sensor at the time of the start of the image forming operation of the aforementioned image forming section.

According to this configuration, it is possible to take measures so that cold offset does not occur by changing the predetermined time until image forming operation is started in accordance with the degree of decrease of the environmental temperature detected by the environmental temperature sensor. In this case, it is possible to change the aforementioned predetermined time at a predetermined rate of change in accordance with the environmental temperature detected by the environmental temperature sensor, or to change the aforementioned predetermined time by preparing an environmental temperature table.

(11) The image forming apparatus of the present invention has a configuration wherein, in the invention described in (1) above, the aforementioned image forming operation control section changes the predetermined time until the image forming operation of the aforementioned image forming section is started after the aforementioned heat-fixing apparatus starts operating in accordance with the processing speed at the time of the image forming operation of the aforementioned image forming section.

Generally, a slower processing speed at the time of image forming operation of the image forming section means that less heat is lost to the pressure roller pressing against the image heating body, and therefore the rise in temperature of the image heating body is more rapid. Consequently, the predicted value of the rate of rise in temperature of the image heating body differs according to the processing speed. With this configuration, since the predetermined time until image forming operation of the aforementioned image forming section is started after the aforementioned heat-fixing apparatus starts operating can be changed in accordance with the processing speed, fixing can be performed in the shortest time at any processing speed. Therefore, according to this configuration, in addition to obtaining the effects of the invention described in (1) above, it is possible for optimal heat-fixing of an unfixed toner image onto the recording medium to be performed.

(12) The image forming apparatus of the present invention has a configuration wherein, in the invention described in (1) above, the aforementioned calorific value control section controls the calorific value of the aforementioned heat-producing section, based on the temperature detected by the aforementioned temperature sensor, so that the temperature of the aforementioned image heating body is maintained at the image fixing temperature suitable for heat-fixing the unfixed toner image onto plain paper used as the recording medium.

With this configuration, control is performed so that the temperature of the image heating body is maintained at an image fixing temperature suitable for plain paper, which is generally the most frequently used. Therefore, according to this configuration, in addition to obtaining the effects of the invention described in (1) above, the effects of enabling the first print time to be shortened and printing defects to be prevented for the first printed sheet are displayed more conspicuously.

(13) The image forming apparatus of the present invention has a configuration wherein, in the invention described in (1) above, the aforementioned image heating body is configured as a belt-shaped member.

According to this configuration, in addition to obtaining the effects of the invention described in (1) above, a temperature sensor with a large thermal time constant, of the same kind as in a conventional heat-fixing apparatus, can be used without any trouble even when the image heating body is configured as a belt-shaped member with a short warm-up time.

(14) The image forming apparatus of the present invention has a configuration wherein, in the invention described in (1) above, the aforementioned temperature sensor has a temperature measuring element that detects the temperature of the aforementioned image heating body, and a nonmetallic elastic body that supports the aforementioned temperature measuring element and is in contact with the aforementioned image heating body at low pressure.

If the elastic body that supports the temperature measuring element is metallic, when an induction heating type of heat-producing section is used, the elastic body produces heat directly due to electromagnetic induction, and therefore it may become impossible to measure the temperature of the image heating body accurately with the temperature measuring element. Consequently, in this case, it is necessary for the temperature sensor to be installed at a location where the elastic body is not directly induction-heated. According to this configuration, in addition to obtaining the effects of the invention described in (1) above, since the elastic body is nonmetallic, this elastic body is not susceptible to direct induction heating, and flexibility with regard to the installation location of the temperature sensor is increased.

(15) The image forming apparatus of the present invention has a configuration wherein, in the invention described in (14) above, the aforementioned elastic body is a sponge.

According to this configuration, in addition to obtaining the effects of the invention described in (14) above, since the elastic body supporting the temperature measuring element is a sponge of low thermal capacity, this elastic body is not susceptible to induction heating, and flexibility with regard to the installation location of the temperature sensor is further increased.

(16) The image forming apparatus of the present invention has a configuration wherein, in the invention described in (14) above, the aforementioned temperature measuring element is a thermistor.

According to this configuration, in addition to obtaining the effects of the invention described in (14) above, since a thermistor that is less expensive and more durable and has greater detection precision than a thermocouple, for example, is used as the temperature measuring element, the reliability of the heat-fixing apparatus can be improved.

This application is based on Japanese Patent Application No. 2003-283044 filed on Jul. 30, 2003, the entire content of which is expressly incorporated by reference herein.

INDUSTRIAL APPLICABILITY

The present invention enables the occurrence of print defects due to first print delay to be eliminated, and is therefore useful as an image forming apparatus equipped with a heat-fixing apparatus that heat-fixes an unfixed toner image onto a recording medium, or the like.

The invention claimed is:

1. An image forming apparatus, comprising:

an image former that forms and holds an unfixed toner image on a recording medium fed to an image forming area; and a heat-fixing apparatus that heats the recording medium transported from the image forming area in a predetermined fixing area and heats the unfixed toner image onto the recording medium; wherein said heat-fixing apparatus comprising:

an image heating body that heats the unfixed toner image on the recording medium;

a heat-producer that heats said image heating body;

a temperature sensor that detects a temperature of said image heating body; and a calorific value controller that controls a calorific value of said heat-producer based on the temperature detected by said temperature sensor so that the temperature of said image heating body is maintained at an image fixing temperature suitable for heat-fixing the unfixed toner image onto the recording medium; and said image forming apparatus has an image forming operation controller that controls an image forming operation of said image former so that heat-fixing of the unfixed toner image onto the recording medium is started a predetermined timing before the temperature detected by said temperature sensor reaches the image fixing temperature.

2. The image forming apparatus according to claim 1, wherein a thermal time constant of said temperature sensor is 1/20 or more of a warm-up time necessary for the temperature of said image heating body to rise to the image fixing temperature.

3. The image forming apparatus according to claim 1, wherein at least part of said image heating body has electrical conductivity and said heat-producer comprises an excitation section that heats said image heating body directly by means of electromagnetic induction.

4. The image forming apparatus according to claim 1, wherein said heat-producer comprises:

a rotatable heat-producing member at least part of which has electrical conductivity and is in contact with said image heating body and heats said image heating body indirectly; and an excitator that heats said heat-producing member by means of electromagnetic induction.

5. The image forming apparatus according to claim 1, wherein said image forming operation controller starts the image forming operation by said image former based on a timing at which the temperature of said image heating body reaches a predetermined temperature, or timing at which elapsed time after a start of operation of said heat-fixing apparatus reaches a predetermined time, whichever timing is earlier.

6. The image forming apparatus according to claim 1, wherein said image forming operation controller starts the image forming operation of said image former only when the temperature of said image heating body following an elapse of a predetermined time after a start of an operation of said heat-fixing apparatus is a temperature within a predetermined range.

7. The image forming apparatus according to claim 1, further comprising a voltage detector that detects a power supply voltage and wherein said image forming operation controller starts the image forming operation of said image former following an elapse of a predetermined time after a start of operation of said heat-fixing apparatus only when the power supply voltage detected by said voltage detector at a time of a start of the image forming operation of said image former is greater than or equal to a predetermined voltage.

8. The image forming apparatus according to claim 1, further comprising a voltage detector that detects a power supply voltage and wherein said image forming operation controller changes a predetermined time until the image forming operation of said image former is started after said heat-fixing apparatus starts operating in accordance with the power supply voltage detected by said voltage detector at a time of a start of the image forming operation of said image former.

9. The image forming apparatus according to claim 1, further comprising an environmental temperature sensor that detects an environmental temperature of a body of said image forming apparatus and wherein said image forming operation controller starts the image forming operation of said image former following an elapse of a predetermined time after a start of operation of said heat-fixing apparatus only when the environmental temperature detected by said environmental temperature sensor at a time of a start of the image forming operation of said image former is greater than or equal to a preset predetermined temperature.

10. The image forming apparatus according to claim 1, further comprising an environmental temperature sensor that detects an environmental temperature of a body of said image forming apparatus, wherein said image forming operation controller changes a predetermined time until the image forming operation of said image former is started after said heat-fixing apparatus starts operating in accordance with the environmental temperature detected by said environmental temperature sensor at a time of a start of the image forming operation of said image former.

11. The image forming apparatus according to claim 1, wherein said image forming operation controller changes a predetermined time until the image forming operation of said image former is started after said heat-fixing apparatus starts operating in accordance with a processing speed at a time of the image forming operation of said image former.

12. The image forming apparatus according to claim 1, wherein said calorific value controller controls the calorific value of said heat-producing section, based on the temperature detected by said temperature sensor, so that the temperature of said image heating body is maintained at the image fixing temperature suitable for heat-fixing the unfixed toner image onto plain paper used as the recording medium.

13. The image forming apparatus according to claim 1, wherein said image heating body is configured as a belt-shaped member.

14. The image forming apparatus according to claim 1, wherein said temperature sensor comprises a temperature measuring element that detects a temperature of said image heating body, and a nonmetallic elastic body that supports said temperature measuring element and is in contact with said image heating body at low pressure.

15. The image forming apparatus according to claim 14, wherein said elastic body is a sponge.

16. The image forming apparatus according to claim 14, wherein said temperature measuring element is a thermistor.

17. An image forming method, comprising:

forming and holding an unfixed toner image on a recording medium fed to an image forming area; and heating the recording medium transported from the image forming area to a predetermined fixing area and fixing the unfixed toner image onto the recording medium, wherein said heating comprises:

using an image heating body to heat the unfixed toner image on the recording medium;

using a heat-producer to heat the image heating body;

detecting a temperature of the image heating body; and controlling a calorific value of the heat-producer based on the detected temperature so that the temperature the image heating body is maintained at an image fixing temperature suitable for heat-fixing the unfixed toner image onto the recording medium; and wherein said image forming method further comprises controlling an image forming operation so that heat-fixing of the unfixed toner image onto the recording medium is started at a predetermined timing before the detected temperature reaches said image fixing temperature.

* * * * *